US005996800A

United States Patent [19]

Pratt

[11] Patent Number: 5,996,800

[45] Date of Patent: Dec. 7, 1999

[54] RESEALABLE PLASTIC BAG HAVING VENTING MEANS

[76] Inventor: David W. Pratt, 5419 Dahlgren, New Port Richey, Fla. 34652

[21] Appl. No.: 09/040,837

[22] Filed: Mar. 18, 1998

[51] Int. Cl.[6] ..... B65D 81/20; B65D 33/01; B65D 39/00

[52] U.S. Cl. ..... 206/524.8; 220/375; 383/3; 383/59; 383/66; 383/103

[58] Field of Search ..... 383/3, 44, 58, 383/59, 61, 62, 82, 66, 80, 100, 103, 63; 206/522, 524.8; 220/375, 797, 601

[56] References Cited

U.S. PATENT DOCUMENTS

| | | | |
|---|---|---|---|
| 1,769,259 | 7/1930 | Henry | 383/80 X |
| 2,200,395 | 5/1940 | Lobl | 383/66 |
| 2,638,263 | 5/1953 | Jesnig | 383/103 |
| 3,946,780 | 3/1976 | Sellers | 383/80 X |
| 3,980,226 | 9/1976 | Franz | 206/524.8 X |
| 4,262,801 | 4/1981 | Avery | 206/522 |
| 5,035,516 | 7/1991 | Pacheco | 383/103 X |
| 5,121,840 | 6/1992 | Schram | 206/522 |
| 5,240,112 | 8/1993 | Newburger | 206/524.8 |
| 5,450,963 | 9/1995 | Carson | 206/529.8 |

FOREIGN PATENT DOCUMENTS

| | | | |
|---|---|---|---|
| 0027861 | 3/1969 | Germany | 383/80 |
| 2603065 | 8/1977 | Germany | 206/574.8 |

*Primary Examiner*—Bryon P. Gehman
*Attorney, Agent, or Firm*—Ronald E. Smith

[57] ABSTRACT

A pair of thin, flexible, plastic panels are secured to one another at preselected peripheral edges to define a plastic bag and an auxiliary panel having an aperture formed in it is attached at its peripheral edges to an exterior side of a preselected panel of the pair of panels to form an auxiliary chamber. An aperture is also formed in the preselected panel in substantial registration with the aperture formed in the auxiliary panel and a valve head of a valve member is disposed between the apertures. In its position of repose, the valve head overlies the aperture formed in the preselected panel and underlies the aperture formed in the auxiliary panel. A valve neck is formed integrally with the valve head and is secured to the exterior side of the preselected panel so that it allows air being forced out of the bag to lift the valve head from the aperture formed in the exterior side of the preselected panel. The valve head returns to its position of repose when the air is no longer being forced out of the bag and the air in the auxiliary chamber escapes into the atmosphere through the aperture formed in the auxiliary panel. In a second embodiment, the valve neck and head are formed integrally with the auxiliary panel. In a third embodiment, an imperforate plug frictionally engages a socket that encircles an aperture formed in a base that is secured to the bag, and the aperture in the base is in registration with an aperture formed in the bag.

2 Claims, 4 Drawing Sheets

RESEALABLE PLASTIC BAG HAVING VENTING MEANS

BACKGROUND OF THE INVENTION

1. Field of the Invention

This invention relates, generally, to containers for storing food and keeping the food fresh. More particularly, it relates to a resealable plastic bag of the type having a venting means for releasing air from the container after the main closure means thereof has been sealed.

2. Description of the Prior Art

It is well-known that bacteria need food, warmth and oxygen to thrive, and that food, therefore, is best stored in a cool, airless environment. Plastic bags for storing perishables provide a reasonably good means for minimizing oxygen flow to bacteria, but the oxygen trapped in the bag when the bag is sealed still enables some bacterial growth. Accordingly, a few inventors have developed resealable plastic bags having means for venting air from the bag after the primary closure means has been sealed. For example, U.S. Pat. No. 5,240,112 to Newburger (1993) discloses a resealable plastic bag having an auxiliary venting means with a structure like that of the primary sealing means. Accordingly, a sandwich is placed in the bag, the primary sealing means is closed, the venting means is opened while air is pressed out of the bag, and the venting means is then closed. The drawback of this approach is that the auxiliary venting means works with the same efficiency as the primary sealing means, i.e., the auxiliary venting means must be manually held open during the venting process, and then quickly closed manually. Air flows so quickly, however, that at least a small volume thereof is able to flow back into the bag through the auxiliary vent opening before it is closed, especially since a near vacuum exists in the bag at the moment the outward airflow ends.

There is a need, then, for an auxiliary venting means having a closure means that does not require manual operation. Specifically, there is a need for an automatic one-way valve auxiliary venting means that opens when air is flowing out of the plastic bag but which closes instantly and automatically if air attempts to flow back into the bag.

However, in view of the art considered as a whole at the time the present invention was made, it was not obvious to those of ordinary skill in this art how the needed improvements could be provided.

SUMMARY OF THE INVENTION

The longstanding but heretofore unfulfilled need for an apparatus that overcomes the limitations of the prior art is now met by a new, useful, and nonobvious invention. The present invention includes a resealable plastic bag of the type formed by a first and a second panel that are sealed to one another at their respective peripheral edges. An auxiliary panel is attached at its peripheral edges to an exterior side of a preselected panel of the first and second panels, thereby defining an auxiliary chamber. A first aperture is formed in the auxiliary panel, and a second aperture is formed in the preselected panel in substantial registration with the first aperture. An imperforate, flexible and resilient valve member, including a neck and a valve head preferably formed of the same plastic of which bag 10 is formed, is positioned intermediate the preselected panel and the auxiliary panel. The valve head is disposed in overlying relation to the aperture formed in the preselected panel and in underlying relation to the aperture formed in the auxiliary panel. The neck of the valve member is hingedly secured to the exterior side of the preselected panel so that the valve head is lifted, by airflow, from the aperture formed in the preselected panel when the primary sealing means of the bag is sealed and air is forced out of the sealed bag into the auxiliary chamber. The valve head returns to overlying relation to the aperture formed in the preselected panel when the airflow ends, thereby opening the aperture formed in the auxiliary panel so that air in the auxiliary chamber escapes into ambient space. Reverse airflow is prevented because the valve head returns to its position of repose, i.e., into overlying relation to the aperture formed in the preselected panel, when air flow from the bag interior ends. Thus, air flowing into the auxiliary chamber through the aperture formed in the auxiliary panel bears against the valve head and increases its seal against the aperture formed in the preselected panel.

In a second embodiment, the valve member and the auxiliary panel are formed integrally with one another to lower the cost of manufacturing the novel resealable bag.

In a third embodiment of the invention, a resealable plastic bag of the type formed by a first and a second panel that are sealed to one another at their respective peripheral edges includes an aperture formed in a preselected panel of the first and second panels. A flat base member having an aperture formed therein is secured to the preselected panel so that the aperture formed in the base member is in registration with the aperture formed in the preselected panel.

A socket means of predetermined configuration is formed in the base member in surrounding relation to the aperture formed in the base member. An imperforate plug means has a complementary configuration relative to the socket means and is adapted to frictionally engage the socket means.

A flexible neck is disposed in interconnecting relation to the socket means and the plug means so that air in the bag is forced out through the aperture formed in the preselected panel and through the aperture formed in the base means when the plug means is disengaged from the socket means. In this way, the plug means is frictionally engaged to the socket means to prevent entry of air into the bag after said air has been forced out of the bag.

The aperture formed in the preselected panel is preferably circular, the socket means is preferably annular, the plug means is preferably annular, and the aperture formed in the base means is circular.

The flexible neck and the plug means overlie the preselected panel when the plug means is disengaged from the socket means.

It is a primary object of this invention to provide a resealable plastic bag having a one-way valve for venting air from the bag and preventing reverse flow of air into the bag.

Another object is to provide such a one-way valve in a simple, economical form so that the improvement does not appreciably drive up the cost of a resealable plastic bag.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
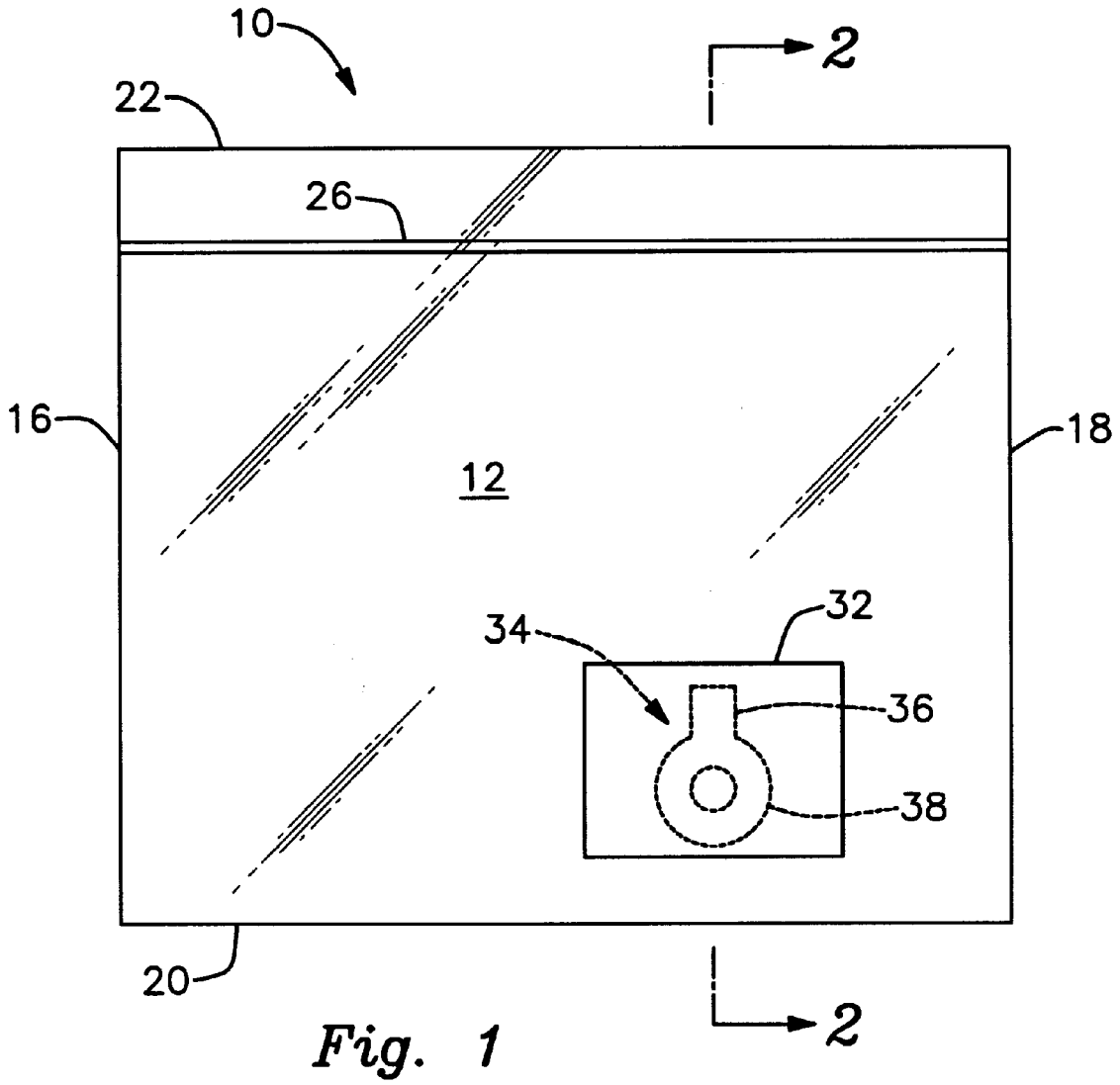
FIG. 1 is an elevational view of a resealable plastic bag having the novel one-way valve of this invention.
Figure 2:
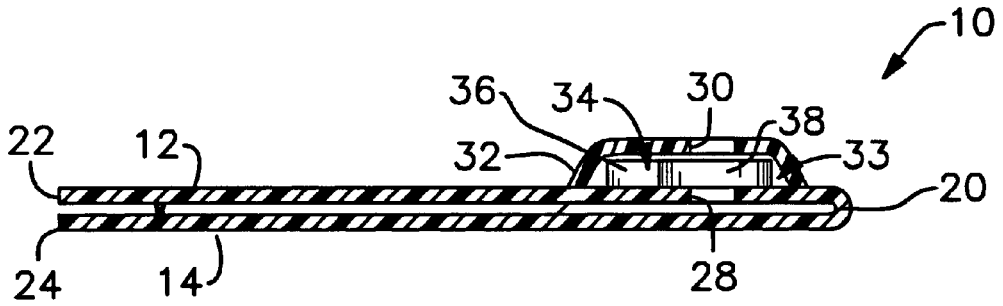
FIG. 2 is a sectional view taken along line 2—2 in FIG. 1.

Referring now to FIGS. 1 and 2, it will there be seen that an exemplary embodiment of the invention is denoted as a whole by the reference numeral 10.

Resealable plastic bag 10 has a front panel 12 and a back panel 14 that are sealed to one another in the well-known way along their respective side edges 16, 18 and lower edges 20. Their respective upper edges 22, 24 are unsealed and are provided with conventional, releasable, primary sealing means denoted 26 as a whole. Structure 26 is well-known and need not be re-described here because it forms no part, per se, of the present invention.

The novel structure to be described hereinafter may be secured to either front panel 12 or back panel 14, it being understood that the designation "front" or "back" is entirely arbitrary. For purposes of discussion only, the novel valve means will be depicted and described as being associated with front panel 12.

A first aperture 28, which may be of any practical size and shape, is formed in said front panel 12 at any practical location. Preferably, aperture 28 is a relatively small circular opening as depicted, and is located near the bottom of bag 10, i.e., near lower edge 20, offset from the center thereof.

A second aperture 30, which may also be of any practical size and shape, is formed in auxiliary panel 32 in substantial registration with first aperture 28. Preferably, second aperture 30 is also a relatively small circular opening as depicted, is located near the bottom of bag 10, i.e., near lower edge 20, offset from the center thereof, in registration with first opening 28 as aforesaid.

It is apparent that a single aperture-forming procedure is preferably used to form first and second apertures 28 and 30 at the same time, i.e., a simple, economical punching operation would be sufficient to simultaneously form said apertures at the time of bag manufacture. The punching operation is performed when front and auxiliary panels 12 and 32 are in registration with one another, thereby assuring that apertures 28 and 30 are in registration with one another. Preferably, aperture 30 is substantially centrally disposed relative to the peripheral edges of auxiliary panel 32.

Auxiliary panel 32 could be as large as front and back panels 12 and 14, but such a large auxiliary panel would represent a waste of materials because said auxiliary panel need not be so large. Preferably, auxiliary panel is substantially smaller than panels 12 and 14, as depicted. Auxiliary panel 32 is preferably heat-sealed or otherwise attached about its peripheral edges in overlying relation to front panel 12 (or back panel 14) at the time of bag manufacture, i.e., on the exterior side of said panel. An auxiliary chamber 33 is therefore formed between auxiliary panel 32 and panel 12.

A valve member 34, preferably made of the same material (plastic) as bag 10, includes a neck 36 and an imperforate valve head 38. Neck 36 is hingedly mounted to the exterior side of front panel 12 (or rear panel 14) in underlying relation to auxiliary panel 32. No adhesive is shown in this particular view, but it should be understood that neck 36 is adhered to panel 12 whereas valve head 38 is not. Neck 36 and hence valve head 38 are mounted so that valve head 38 swings outwardly (relative to the interior of the bag) when air is being forced from bag 10 by a consumer. Thus, valve head 38 swings inwardly (toward the interior of the bag) when air attempts to flow into the bag interior.

The hinged connection referred to herein is preferably a living hinge, i.e., neck 36 is heat-sealed or otherwise secured or adhered at its base to the exterior surface of panel 12 or 14 at the time of bag manufacture so that neck 36 is attached and valve head 38 is unattached to said panel and is thus free to swing or pivot relative to neck 36. Thus, there is very little resistance to movement of valve head 38. Accordingly, valve head 38 overlies aperture 28 formed in the preselected panel and underlies aperture 30 formed in auxiliary panel 32 when bag 10 is in repose. When air is squeezed from bag 10, air flowing out of the bag lifts valve head 38 as long as said air continues to flow out. As soon as the outward flow ends, the resiliency of the valve means restores valve head 38 to its position of repose. Air that tries to enter into bag 10 causes valve head 38 to be displaced toward the interior of the bag, thereby increasing the sealing function of the valve head over aperture 28 formed in the preselected panel.

In this way, air that has been squeezed out of bag 10 cannot enter back into the bag as soon as the outward flow of air has ended. Instead, any reverse movement of air immediately seals the valve head tightly against interior aperture 28, independently of human intervention.

Figure 3:
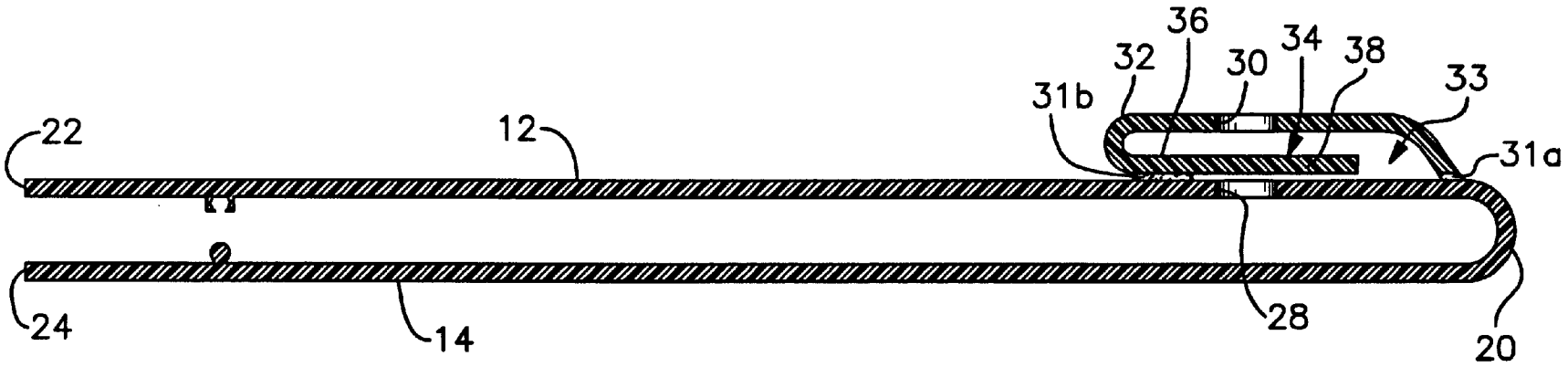
FIG. 3 is a sectional view depicting a second embodiment.

A second embodiment is depicted in FIG. 3; it is essentially the same as the embodiment of FIGS. 1 and 2, but valve neck 36 and valve head 38 are now integrally formed with auxiliary panel 32 to reduce manufacturing costs; a return bend is formed in said auxiliary panel to form valve member 34. Reference numeral 31*a* indicates adhesive that bonds auxiliary panel 32 to panel 12 and reference numberal 31*b* indicates adhesive that bonds neck 36 of valve member 34 to said panel 12, leaving valve head 38 free to operate in the same manner as set forth above in connection with the first embodiment.

Figure 4:
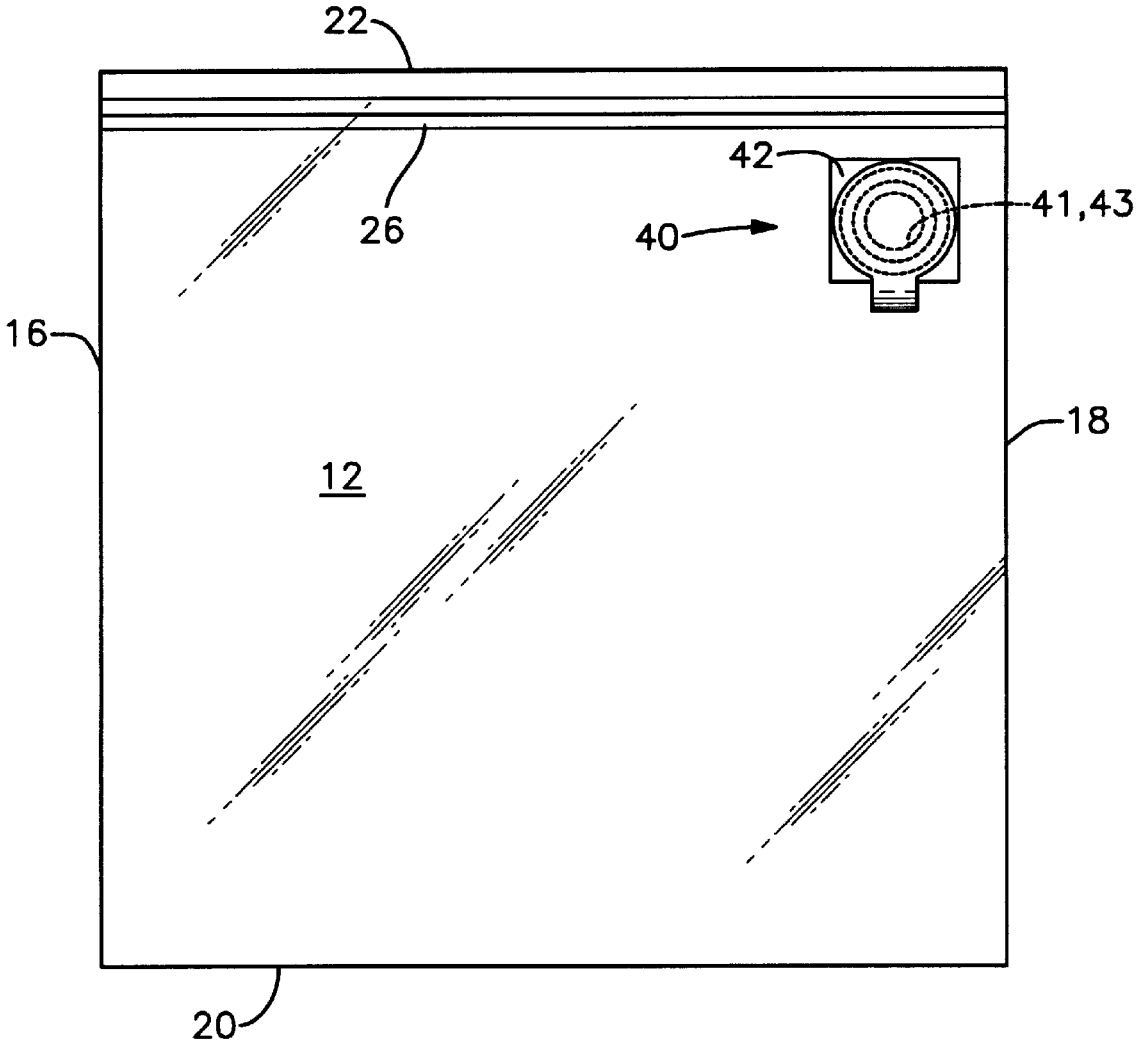
FIG. 4 is an elevational view of a resealable plastic bag equipped with a third embodiment of the invention.
Figure 5:
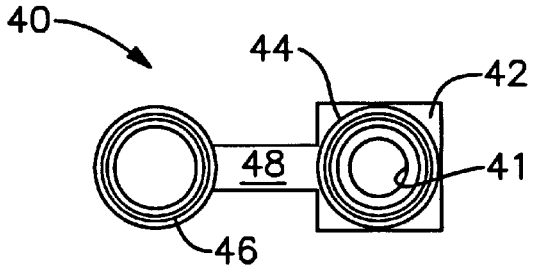
FIG. 5 is an elevational view of the auxiliary vent valve of the third embodiment when said valve is in its open configuration.
Figure 6:
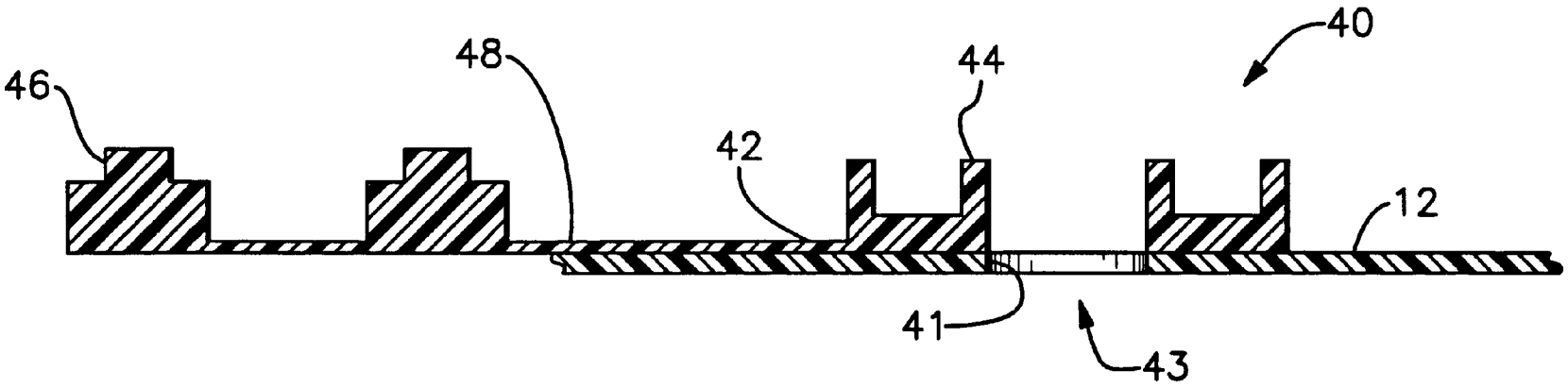
FIG. 6 is a side view of the structure depicted in FIG. 5.

A third embodiment of the invention, depicted in FIGS. 4–7 and denoted 40 as a whole, includes a flat base 42, made of the same material as the resealable bag, that is heat sealed or otherwise affixed in overlying relation to bag panel 12 at any suitable location such as the location depicted in FIG. 4.

A central aperture 41 is formed in base 42, and said aperture 42 is in registration with an aperture 43 of substantially the same size and configuration that is formed in panel 12 of the resealable bag.

Figure 7:
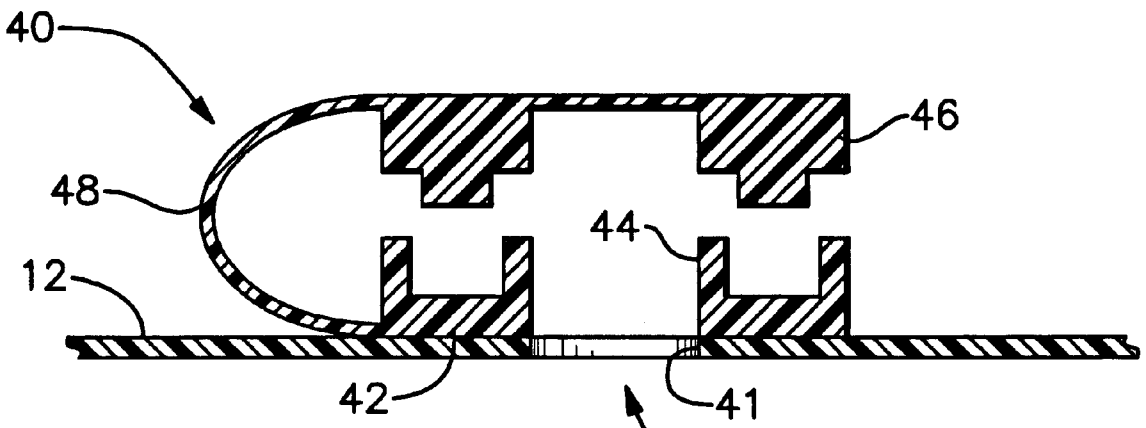
FIG. 7 is a side view of the structure depicted in FIG. 6 when the auxiliary vent means of the third embodiment is in its closed configuration.

An annular, upwardly-opening "U"-shaped channel or socket 44 is formed in or secured to base 42. More particularly, said socket 44 is formed in the rim of annular wall 44*a* that circumscribes aperture 41 and hence aperture 43, said annular wall being formed integrally with base 42. Socket 44 serves as the catch part of a latch means that includes an annular, complementary-shaped plug 46 that frictionally engages socket 44 when flexible neck 48, that interconnects base 42 and plug 46, is bent so that plug 46 overlies and engages socket 44 as depicted in FIG. 7.

To use this embodiment of the invention, as much air as is practicable is squeezed from the bag prior to sealing of resealing means 26, just as in the first and second embodiments. Plug 46 is then disengaged from socket 44, and more air is squeezed out through aperture 43 formed in panel 12 and central aperture 41 formed in base 42. Plug 46 is then brought into locking engagement with socket 44 and pressed tightly to frictionally secure such engagement so that air cannot leak into the interior of the bag.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A resealable plastic bag formed by a first panel and a second panel that are sealed to one another at their respective peripheral edges, comprising:

a circular aperture formed in a preselected panel of said first and second panels;

a flat base having a circular aperture formed therein, said flat base being secured to said preselected panel so that said aperture formed in said base is in registration with said circular aperture formed in said preselected panel;

an upstanding annular wall, formed integrally with said flat base, disposed in surrounding relation to said circular aperture formed in said base;

an annular socket means formed in an upper rim of said annular wall;

an imperforate annular plug means of complementary configuration to said annular socket means, said annular plug means adapted to frictionally engage said annular socket means;

a flexible neck disposed in interconnecting relation to said annular socket means and to said annular plug means;

whereby air in said bag is forced out through said aperture formed in said preselected panel and through said aperture formed in said base when said annular plug means is disengaged from said annular socket means; and whereby said annular plug means is frictionally engaged to said annular socket means to prevent entry of air into said bag after said air has been forced out of said bag.

2. The resealable plastic bag of claim 1, wherein said flexible neck and said plug means overlie said preselected panel when said plug means is disengaged from said socket means.

* * * * *